United States Patent [19]

Resch, Jr.

[11] 4,057,306

[45] Nov. 8, 1977

[54] GANG LOCK ASSEMBLY FOR CABINET DRAWERS

[75] Inventor: Alvin Charles Resch, Jr., Two Rivers, Wis.

[73] Assignee: American Hospital Supply Corporation, Evanston, Ill.

[21] Appl. No.: 697,248

[22] Filed: June 17, 1976

[51] Int. Cl.[2] ..... E05B 65/46

[52] U.S. Cl. ..... 312/218; 312/220

[58] Field of Search ..... 312/220, 221, 219, 222, 312/218, 216, 217; 70/85, 86; 292/147

[56] References Cited

U.S. PATENT DOCUMENTS

| | | | |
|---|---|---|---|
| 1,730,909 | 10/1929 | Anderson et al. | 312/218 |
| 1,847,106 | 3/1932 | Turner | 312/219 |
| 2,835,547 | 5/1958 | Brismann | 312/219 |
| 3,371,974 | 3/1968 | Vermeersch | 312/221 |
| 3,776,007 | 12/1973 | Himsl | 312/219 |

FOREIGN PATENT DOCUMENTS

| | | | |
|---|---|---|---|
| 724,486 | 2/1955 | United Kingdom | 312/220 |
| 237,421 | 7/1925 | United Kingdom | 292/147 |

*Primary Examiner*—Paul R. Gilliam
*Assistant Examiner*—Alexander Grosz

[57] ABSTRACT

A gang lock assembly for locking the drawers of a cabinet includes a vertically extending locking bar behind each vertical row of drawers and a latch on each drawer engageable with the locking bar for locking the drawer. Each locking bar is pivotable about a vertical axis, and a connecting bar connects the locking bars for simultaneous pivoting movement between locking and unlocking positions. An actuator operable by one of the drawers is engageable with the locking bar behind said one drawer for pivoting the locking drawer to its locked position as the drawer is closed.

8 Claims, 10 Drawing Figures

GANG LOCK ASSEMBLY FOR CABINET DRAWERS

BACKGROUND AND SUMMARY

This invention relates to an improved gang lock assembly for a cabinet, i.e., a lock assembly for simultaneously locking and unlocking a plurality of drawers.

The inventive gang lock assembly includes a vertically extending locking bar behind each row of drawers which eliminates the need to align each individual locking latch on the drawers. Accordingly, drawers of different heights can be used in the cabinet, and the latch behind each drawer will engage the locking bar regardless of the vertical position of the drawer. Each locking bar is pivotable about a vertical axis, and the locking bars are connected by a connecting rod so that they pivot simultaneously. One of the drawers moves an actuator rearwardly when the drawer is closed, and the actuator moves the locking bar behind the drawer, and thereby each of the other locking bars, into the locking position. The drawers need not be in their closed positions when the locking bars are pivoted to their locking positions, and the latch on each drawer engages the locking bar behind the drawer and locks the drawer when the drawer is closed. In one embodiment of the invention the drawer which carries the lock can be fully closed when the drawers are unlocked.

DESCRIPTION OF THE DRAWING

The invention will be explained in conjunction with illustrative embodiments shown in the accompanying drawings, in which—

DESCRIPTION OF THE SPECIFIC EMBODIMENTS

Figures 1, 2, 3, 4, 5:
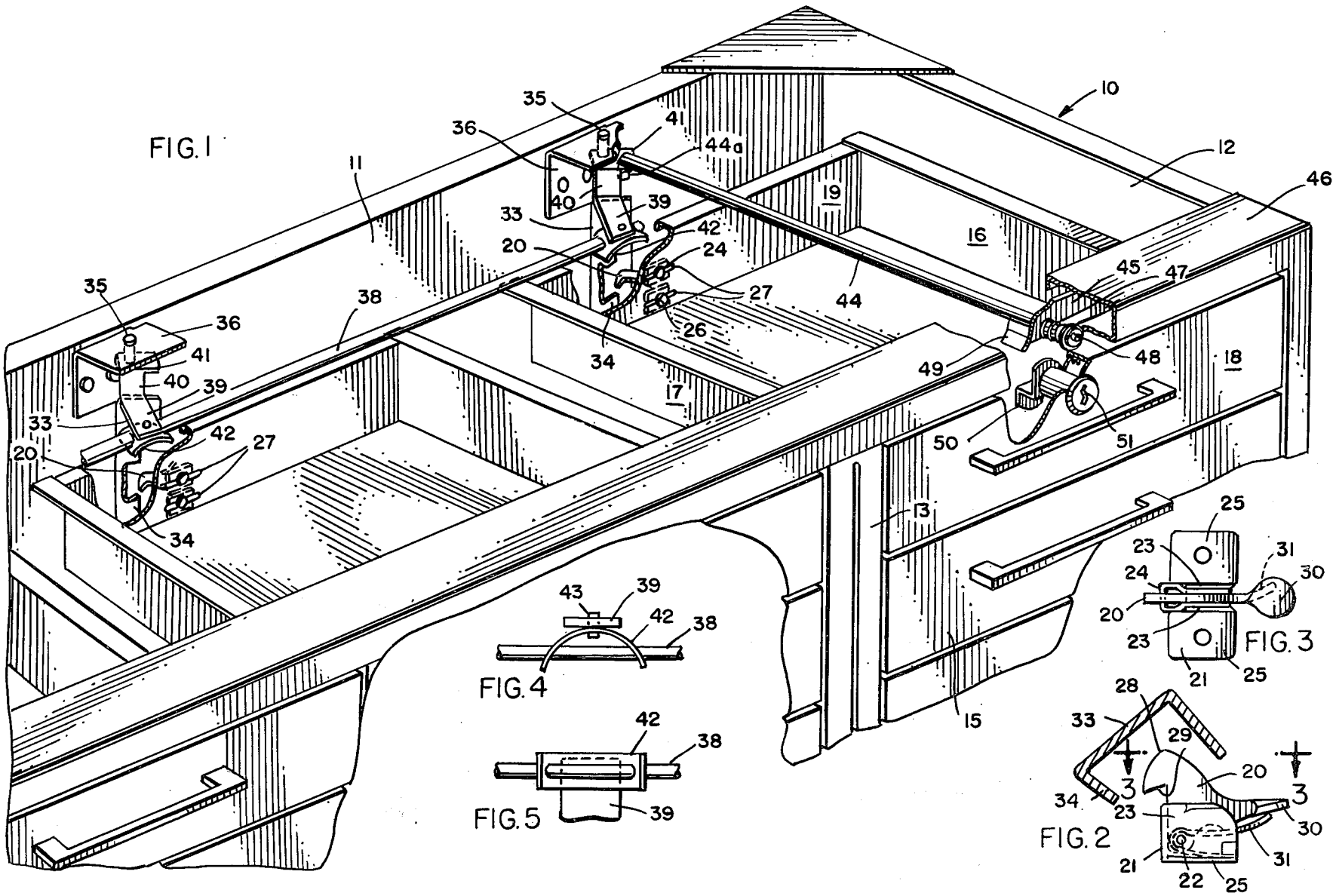
FIG. 1 is a fragmentary perspective view of a cabinet equipped with one embodiment of the inventive gang lock assembly showing the lock assembly in the unlocked position.
FIG. 2 is a top sectional view of one of the locking bars and locking latches of FIG. 1.
FIG. 3 is an elevational view of the locking latch of FIG. 2 as would be seen along the line 3—3 of FIG. 2.
FIG. 4 is a fragmentary elevational view showing the connection between the connecting rod and the crank arms.
FIG. 5 is a fragmentary bottom plan view of the structure of FIG. 4.

Referring to FIGS. 1 and 4, a cabinet 10 includes a back wall 11, a side wall 12, and a front frame 13. The top of the cabinet is removed for clarity of illustration. The front frame is provided with a plurality of vertical rows of openings, and a drawer is slidably mounted within each opening in the conventional manner. Each drawer is movable from the closed position illustrated to an open position.

Each drawer 15 includes side walls 16 and 17 and front and back walls 18 and 19. A latch 20 (see also FIGS. 2 and 3) is pivotally mounted on the back wall of each drawer. Each latch is pivotally mounted in a support bracket 21 by a pin 22. Each of the support brackets includes a pair of horizontally extending support walls 23 between which each latch is inserted, a connecting wall 24, and a pair of vertically extending mounting flanges 25. Each of the mounting flanges is secured to the drawer by a bolt 26 (FIG. 1) which extends through one of a pair of horizontally extending slots 27 in the back of the drawer. The latch includes a hook portion 28 which is provided with a flat latching surface 29 and a lever portion 30. The latch is resiliently urged toward the position illustrated in FIG. 2 in which the latch abuts the connecting wall 24 by a spring 31. The spring is looped around the pin 21, and the two ends of the spring engage the lever portion 30 and an extension of one of the mounting flanges 25 to urge the latch to pivot counterclockwise as viewed in FIG. 2.

The latches on each vertical row of drawers are engageable with a vertically extending locking bar 33 which is pivotally mounted on the back wall of the cabinet. Each locking bar in the embodiment illustrated is generally V-shaped in horizontal cross section and includes a locking edge portion 34 which extends towards the latches. A pivot pin 35 is welded to the upper end of the locking bar and extends upwardly beyond the top of the locking bar through an opening in a mounting bracket 36 which is bolted to the back of the cabinet. The bottom of the locking bar is similarly pivotally supported by a pivot pin and mounting bracket.

Figures 6, 7:
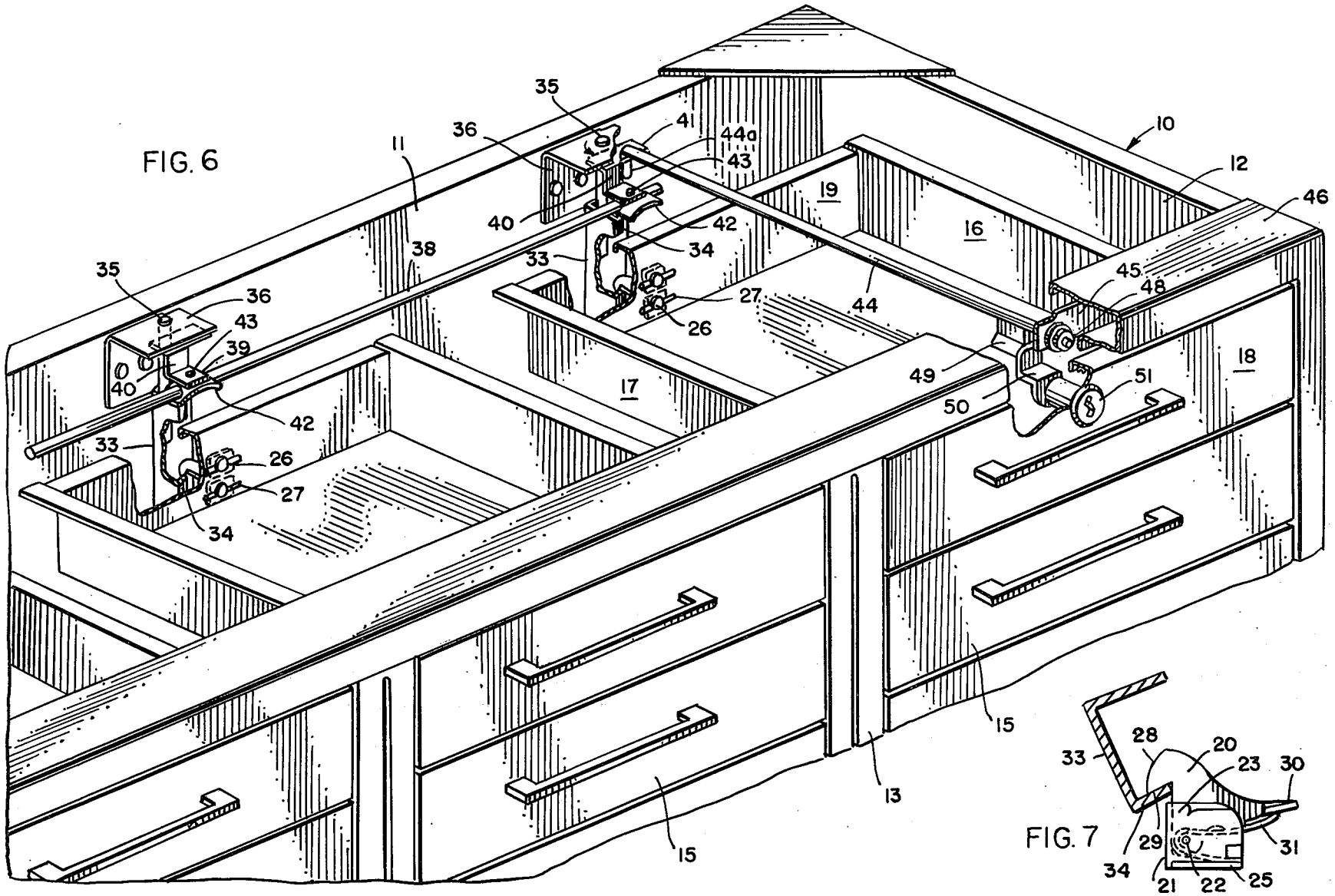
FIG. 6 is a view similar to FIG. 1 showing the lock assembly in the locked position.
FIG. 7 is a top sectional view of one of the locking bars and locking latches of FIG. 6.

Each locking bar is pivotable about a vertical axis between an unlocking or released position (FIGS. 1 and 2) in which the locking edge portion of the locking bar is positioned laterally away from the latches of the drawers and a locking position (FIGS. 6 and 7) in which the locking edge is positioned in front of the latching surfaces 29 of the latches. When the locking bar is in the locking position, the locking edge 34 extends angularly away from the back of the drawer parallel to and adjacent the flat latching surface of each of the latches. Each latch is therefore engageable with the locking bar if the drawer is pulled outwardly, and the drawer will be locked in the closed position.

The locking bars are connected for simultaneous pivoting movement by a horizontally extending connecting rod 38 which is pivotally connected to a crank arm 39. The crank arm includes a vertically extending mounting portion 40 which is welded to the pivot rod 35 for rotation therewith. An upper crank arm 41 extends from the top of the mounting portion generally perpendicularly to the crank arm 39 and is provided with an opening through which the pivot pin 35 extends. However, the upper crank arm is functional only with respect to one of the locking bars and may be eliminated if desired on the others. Each of the lower crank arms 39 is pivotally connected to the connecting rod 38 by a curved flexible and resilient spring blade 42 (FIGS. 4 and 5) which is pivotally secured to the crank arm 39 by a rivet 43. The curved spring blade is provided with an opening adjacent each end through which the rod extends, and the relaxed or untensioned configuration of the spring blade is substantially flatter than the configuration illustrated in FIG. 4. The rod is inserted through the holes in each spring blade by squeezing the ends of the blade together, and when the ends are released, the spring blade frictionally grips the rod and prevents sliding movement of the rod relative to the spring blade. The spring blade permits a common rod to be used for various sized cabinets.

The locking bars behind the rows of drawers are pivoted simultaneously by means of a horizontally extending actuator or push rod 44 which is slidably mounted on the cabinet above one of the rows of drawers. In the embodiment illustrated, the push rodis mounted above the right hand row. The front end of the push rod extends through an opening in a support wall 45 which is attached to the top channel 46 of the front frame of the cabinet, and the rear end of the push rod is bent vertically downwardly at 44*a* to extend through an opening in the end of the crank arm 41. The push rod is biased to a forward position illustrated in FIG. 1 by a coil spring 47 which is mounted on the front end of the rod between the wall 45 and a stop washer 48 secured to the end of the rod. A downwardly extending V-shaped lug 49 secured to the push rod engages the wall 45 to limit the forward movement of the push rod.

When the push rod is in its forward position, the locking bar behind the right hand row of drawers is maintained in its unlocking position by the crank arm 41. The crank arms 41 and 39 act as a bell crank, and the connecting rod 38 maintains all of the other locking bars in their unlocking positions.

The push rod is movable rearwardly by a cam 50 which is rotatable by a lock 51 mounted in the front wall of the top drawer of the right hand row. The cam is rotatable from a downwardly extending or unlocked position (FIG. 1) to an upwardly extending or locked position (FIG. 6) by a key which can be inserted into the key opening of the lock. The cam 50 can be rotated into its upwardly extending locked position by first pulling the top drawer outwardly, and then turning the key to rotate the cam. As the top drawer is pushed toward its closed position, the cam engages the lug 49 on the push rod and moves the push rod rearwardly to the position illustrated in FIG. 6. Rearward movement of the push rod pivots the crank arms 41 and 39 and the right hand locking bar to the locked position illustrated in FIG. 6, and the connecting rod 38 pivots the other locking bars to their locked positions. As the right hand locking bar pivots to its locked position, the locking edge 34 thereof will move into locking relationship with respect to the latch on the top drawer to prevent the top drawer from being pulled outwardly.

Any of the other drawers which are fully closed will also be locked by engagement of the locking bar behind the drawer with the latch on the drawer. Any drawer which is in an open position when the locking bars are moved to the locking position can be closed and locked simply by pushing the drawer closed. As the latch on the drawer moves rearwardly, the curved outer surface of the hook portion 28 (FIG. 7) will engage the locking edge 34 of the bar, and the latch will pivot clockwise to permit the latch to move behind the locking edge portion. When the latching surface 29 of the latch clears the locking edge, the spring 31 of the latch will return the latch to its locking position.

When it is desired to unlock the drawers, the key is inserted into the lock 51 to rotate the cam 50 to its downward position. The spring 47 will then return the push rod 44 to its forward position, thereby pivoting the locking bars to the unlocking position of FIG. 1.

The gang lock assembly permits all of the drawers of the cabinet to be locked merely by operating a single lock on one of the drawers. The drawer which carries the lock can be locked without closing the other drawers, and this permits the other drawers to be closed and locked even when the person holding the key is not present. When the locking assembly is in the unlocked position, all of the drawers, even the drawer carrying the lock, can be completely closed. The V-shaped lug 49 on the push rod 44 includes a lower portion which is angled toward the cam 50 on the lock, and this prevents the cam from being moved to the locking position when the top drawer is closed. The locking assembly can be locked only by first opening the top drawer and then turning the key to move the cam to its upwardly extending position. The locking assembly is then locked merely by closing the top drawer.

The vertically extending locking bars extend continuously from the top drawer of each row to the bottom drawer of each row and eliminate the need to align the vertical position of each locking mechanism. Locking action of the lock bar occurs by a pivoting movement about a vertical axis, and the latches will therefore engage the locking bar at any position along its length. Horizontal adjustment of each latch is permitted by the horizontally extending slots 27 in the back of each drawer. The invention is particularly useful in modular cabinetry in which drawers of different heights may be combined merely by selecting the proper height position for the drawer runs. The gripping spring blades 42 are also advantageous in modular cabinetry since a common rod can be used for different size cabinets.

Figures 8, 9:
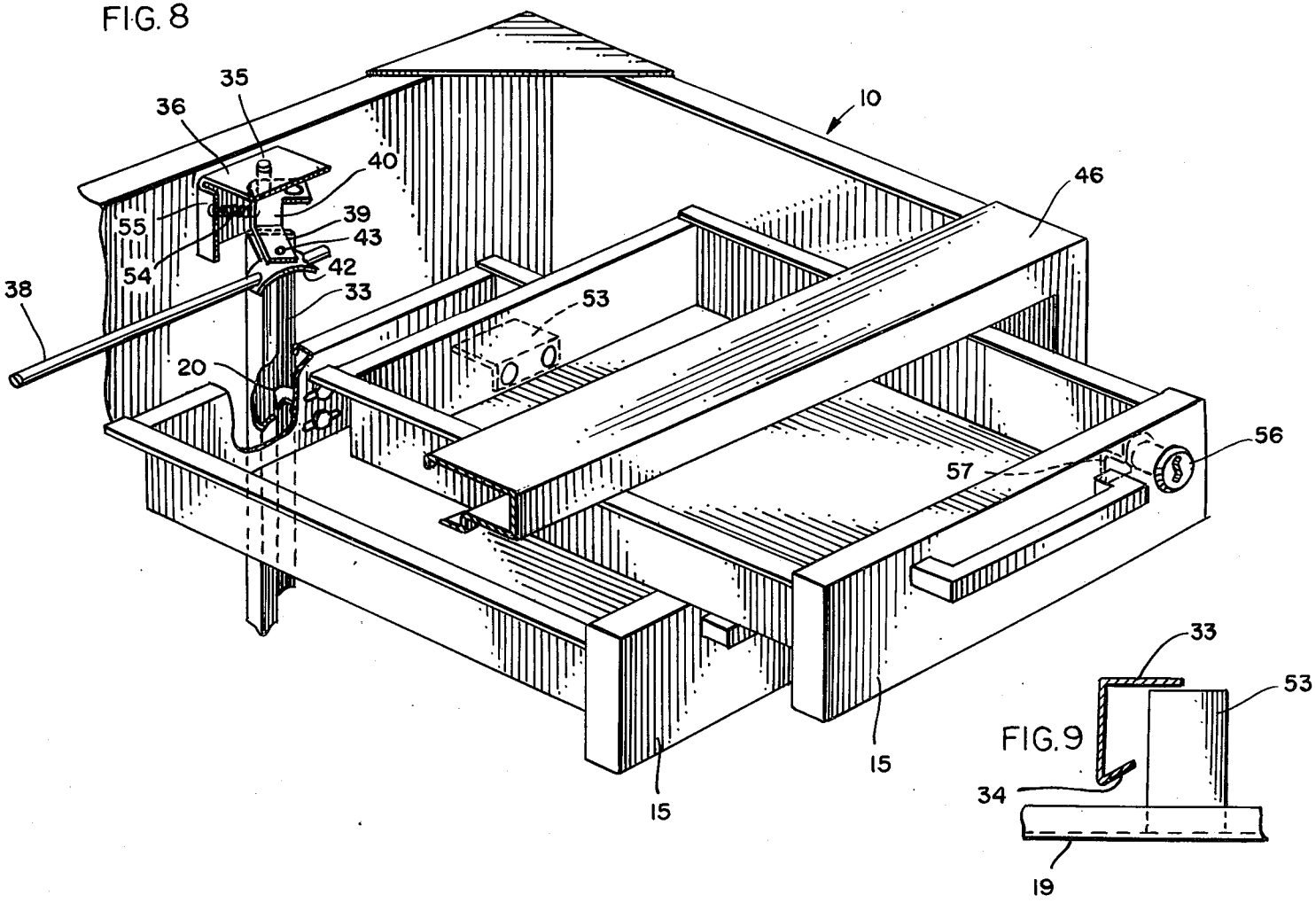
FIG. 8 is a fragmentary perspective view of a cabinet equipped with another embodiment of a gang locking assembly.
FIG. 9 is a fragmentary top plan view of the locking bar and actuator behind the top drawer of FIG. 8.
Figure 10:
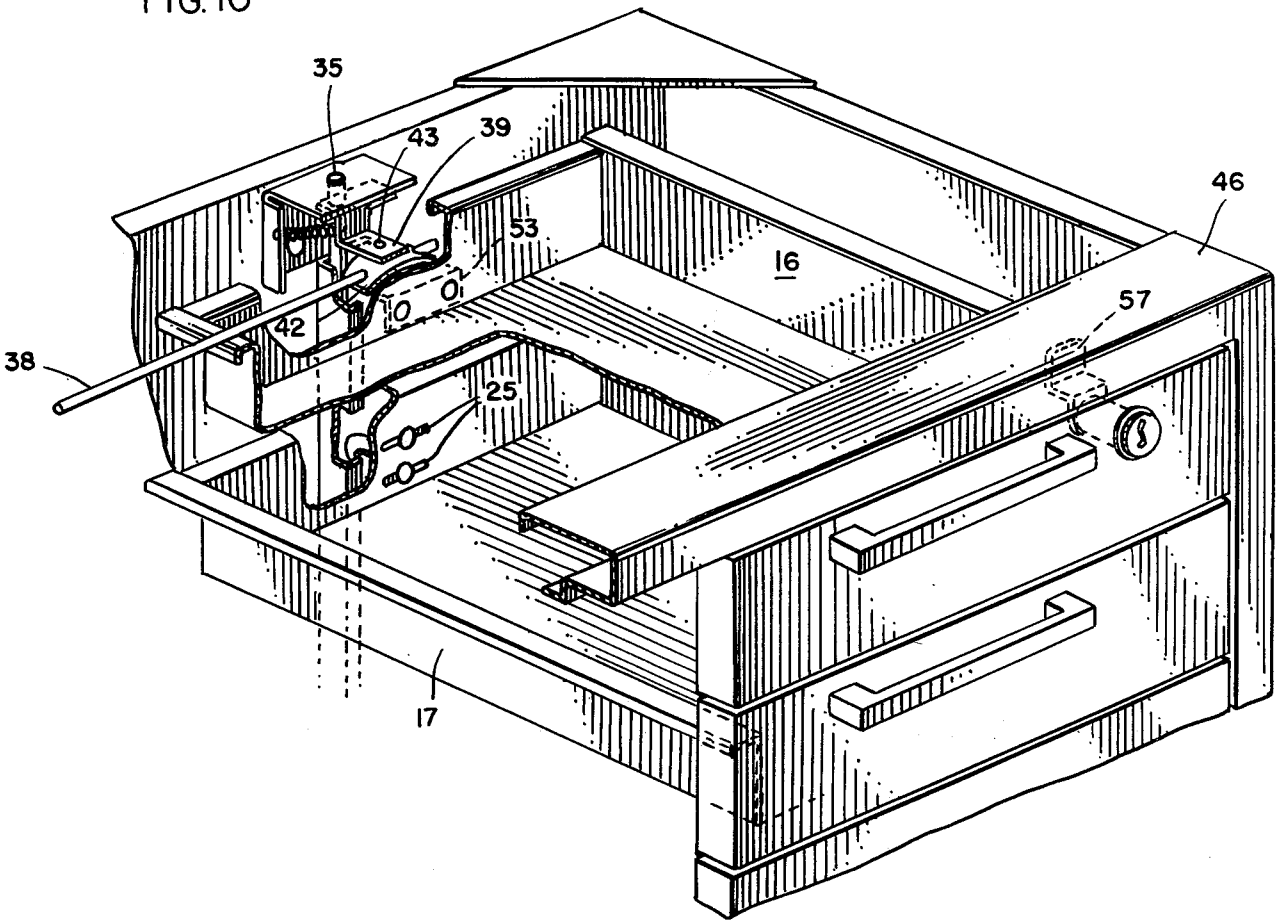
FIG. 10 is a fragmentary perspective view of the cabinet of FIG. 8 showing the drawers in the locked position.

A simplified gang lock assembly is illutrated in FIGS. 8–10, in which like reference numerals designate like parts. The drawers 15 are similarly provided with latches 20 which are engageable with locking bars 33 behind each vertical row of drawers. In the embodiment illustrated in FIGS. 8–10, however, the push rod 44 is eliminated, and the right hand locking bar is instead movable to its locked position by an L-shaped actuating bracket 53 which is bolted to the back of the top drawer. The right locking bar is resiliently urged toward its unlocking position of FIG. 8 by a spring 54 which is connected to the mounting portion 40 of the crank arm 39 and to a flange 55 which extends forwardly from the mounting bracket 36. When the top drawer is moved rearwardly, the actuator 53 engages the locking bar (FIG. 8) and pivots the locking bar counterclockwise to its locking position. The pivoting movement of the right hand locking bar and crank arm 39 moves the other locking bars by means of the connecting rod 38.

The top drawer is locked in its closed position by a lock 56 which includes a latch 57 which is rotatable from a downwardly extending position illustrated in FIG. 8 to an upwardly extending position illustrated in FIG. 10 in which it is engageable with the back of the top channel 46 to prevent opening of the drawer. Since the top drawer is locked by the lock 56, the back of the drawer need not be provided with a latch 20.

While in the foregoing specification detailed descriptions of specific embodiments of the invention were set forth for the purpose of illustration, it is to be understood that many of the details herein given may be varied considerably by those skilled in the art without departing from the spirit and scope of the invention.

I claim:

1. A gang lock assembly for locking a plurality of drawers in a cabinet, each drawer being slidably mounted in the cabinet for movement between a closed position and an open position in which the drawer extends forwardly from the front of the cabinet, the gang lock assembly comprising a latch mounted on the rear end of each drawer, a vertically extending locking bar pivotally mounted on the cabinet behind each drawer for pivoting movement about a vertical axis, each locking bar being pivotable between a locking position in which the locking bar is engageable with the latch on the drawer forwardly of the bar when the drawers are in their closed position to prevent movement of the drawers to their open position and an unlocking position in which the locking bar is not engageable with the latch on the drawer forwardly of the bar, an actuating rod mounted on the cabinet and connected to the locking bar behind one of the drawers, the actuator rod being movable between a forward position in which the locking bar is in its unlocking position and a rearward position in which the locking bar is in its locking position, and cam means on said one drawer engageable with the actuator rod for moving the actuator rod to its rearward position when said one drawer moves to its closed position whereby the actuator rod pivots the locking bar to its locking position.

2. The gang lock assembly of claim 1 in which the drawers are arranged in horizontally spaced rows, a vertically extending locking bar being pivotally mounted on the cabinet behind each of the rows of drawers, and connecting means extending from the locking bar behind said one drawer to each of the other locking bars for pivoting the other locking bars to their closed position when the locking bar behind said one drawer is pivoted to its closed position.

3. The gang lock assembly of claim 2 in which the connecting means includes a crank attached to each locking bar and extending generally horizontally therefrom, a curved flexible and resilient spring blade pivotally secured to each of the cranks, and a connecting rod extending through a pair of openings in each spring blade and being frictionally gripped thereby.

4. The gang lock assembly of claim 1 in which said cam means on said one drawer includes a cam pivotable about a horizontal axis between a raised position in which it is engageable with the rod and a lowered position in which said one drawer can move to its closed position without engaging the rod.

5. The gang lock assembly of claim 1 including a stop member extending downwardly from the bar, said cam means on said one drawer including a cam pivotable about a horizontal axis between a raised position in which it is engageable with the stop member for moving the rod to its rearward position when said one drawer moves to its said closed position and a lowered position in which said one drawer can move to its closed position without engaging the stop member, the stop member being engageable with the cam when said one drawer is in its closed position and said cam is in its lowered position to prevent the cam from moving to its raised position.

6. The gang lock assembly of claim 5 in which the drawers are arranged in horizontally spaced rows, a vertically extending locking bar being pivotally mounted on the cabinet behind each of the rows of drawers, a crank attached to each locking bar and extending generally horizontally therefrom, a curved flexible and resilient spring blade pivotally secured to each of the cranks, and a connecting rod extending through a pair of openings in each spring blade and being frictionally gripped thereby whereby all of the locking bars are pivoted to their closed positions when the locking bar behind said one drawer is pivoted to its closed position.

7. A gang lock assembly for locking a plurality of horizontally spaced drawers in a cabinet, each drawer being slidably mounted in the cabinet for movement between a closed position and an open position in which the drawer extends forwardly from the front of the cabinet, a lock on one of said drawers for locking the drawer in its closed position, the gang lock assembly comprising a latch mounted on the rear end of each drawer except said one drawer, a vertically extending locking bar pivotally mounted on the cabinet behind each drawer for pivoting movement about a vertical axis, each locking bar being pivotable between a locking position in which the locking bar is engageable with the latch on the drawer forwardly of the bar when the drawers are in the closed position to prevent movement of the drawers to their open position and an unlocking position in which the locking bar is not engageable with the latch on the drawer forwardly of the bar, said one drawer being engageable with the locking bar therebehind to pivot the locking bar to its locking position as said one drawer moves to its closed position, a crank attached to each locking bar and extending generally horizontally therefrom, and a connecting rod extending between the cranks of each pair of adjacent locking bars and pivotally connected thereto whereby all of the locking bars are pivoted to their locking positions as the locking bar behind said one drawer is pivoted to its locking position.

8. The gang lock assembly of claim 7 including a curved flexible and resilient spring blade pivotally secured to each of the cranks, the connecting rod extending through a pair of openings in each spring blade and being frictionally gripped thereby.

* * * * *